US007465198B2

(12) United States Patent
Su et al.

(10) Patent No.: US 7,465,198 B2
(45) Date of Patent: Dec. 16, 2008

(54) PRESS-FIT POWER CONNECTOR

(75) Inventors: Hou-An Su, Sijhih (TW); You-Hua Cai, Sijhih (TW); Hai-Wen Yang, Sijhih (TW); Jie-Xian He, Sijhih (TW); Jia-Le Zhang, Sijhih (TW)

(73) Assignee: Nextronics Engineering Corp., Taipei County (TW)

( * ) Notice: Subject to any disclaimer, the term of this patent is extended or adjusted under 35 U.S.C. 154(b) by 0 days.

(21) Appl. No.: 11/723,782

(22) Filed: Mar. 22, 2007

(65) Prior Publication Data

US 2008/0233809 A1 Sep. 25, 2008

(51) Int. Cl.
*H01R 13/40* (2006.01)

(52) U.S. Cl. ..... 439/733.1; 439/751

(58) Field of Classification Search ..... 439/733.1, 439/603, 444, 751, 851, 82
See application file for complete search history.

(56) References Cited

U.S. PATENT DOCUMENTS 5,147,227 A * 9/1992 Yurko ..... 439/733.1

* cited by examiner

*Primary Examiner*—Javaid Nasri
(74) *Attorney, Agent, or Firm*—Rosenberg, Klein & Lee

(57) ABSTRACT

A press-fit power connector includes a female terminal base, a plurality of female power terminals and a plurality of female signal terminals. The female power terminals and the female signal terminals are mounted on the female terminal base. Each female power terminal has a terminal contacting portion, a fixing portion, and a pin portion. The terminal contacting portion has an end hole and a clamp slot on one end, and the end hole connects with the clamp slot. The fixing portion is formed by extending the other end of the terminal contacting portion and has at least one borehole. The pin portion is formed by bending and extending one end of the fixing portion which is far away from the terminal contacting portion and has an eye of needle. Based on the above structure, the present invention can improve the yield of products and reduces manufacturing costs.

3 Claims, 12 Drawing Sheets

PRESS-FIT POWER CONNECTOR

BACKGROUND OF THE INVENTION

1. Field of the Invention

The present invention relates to a press-fit power connector, and more especially to a power terminal structure for a press-fit power connector.

2. Description of the Prior Art

Connector devices are electrical assemblies which are widely used. There are a wide variety of connector devices. As shown in FIG. 1, a press-fit power connector device mounted in a power supply includes a female connector 1*a* and a male connector 2*a*. The female connector 1*a* and the male connector 2*a* respectively have a plurality of female and male signal terminals 11*a*, 21*a* and a plurality of female and male power terminals 12*a*, 22*a*. One end of each terminal on the female connector la and one end of each terminal on the male connector 2*a* electrically connect to two circuit boards 3*a*, 4*a* respectively, and the other ends connect with each other.

As shown in FIG. 2, the prior art female power terminal 12*a* includes a terminal contacting portion 121*a*, a fixing portion 122*a*, and a pin portion 123*a*. The terminal contacting portion 121*a* has an end hole 1211*a* on one end and a groove 1212*a* on one side. The fixing portion 122*a* extends from the other end of the terminal contacting portion 121*a*. The fixing portion 122*a* is formed by a plurality of cylinders with different external diameters connecting with each other. The cylinder which is further away from the terminal contacting portion 121*a* has a smaller external diameter. The cylinder most close to the terminal contacting portion 121*a* has a borehole 1221*a* on. The pin portion 123*a* parallelly extends from the end of the fixing portion 122*a*, which is far away from the terminal contacting portion 121*a*. There is an opening 1231*a* on the pin portion 123*a*.

However, though the prior art female power terminals 12*a* could be used, they cannot meet all needs. The prior art female power terminals 12*a* have low yield and high manufacturing cost.

Hence, the inventors of the present invention believe that the shortcomings described above are able to be improved and finally suggest the present invention which is of a reasonable design and is an effective improvement based on deep research and thought.

SUMMARY OF THE INVENTION

An object of the present invention is to provide a press-fit power connector with high yield and low manufacturing cost.

To achieve the above-mentioned object, a press-fit power connector in accordance with the present invention is disclosed. A press-fit connector includes a female terminal base; a plurality of female signal terminals mounted on the female terminal base; and a plurality of female power terminals mounted on the female terminal base, each having a terminal contacting portion, a fixing portion, and a pin portion. Furthermore, the terminal contacting portion and the fixing portion are mounted inside the female terminal base, the pin portion is disposed outside the female terminal base, the terminal contacting portion has an end hole and a clamp slot on one end, the end hole connects with the clamp slot, the fixing portion is formed by extending the other end of the terminal contacting portion and the pin portion is formed by bending and extending one end of the fixing portion which is far away from the terminal contacting portion.

The efficacy of the present invention is as follows: the structural design of the female power terminal can improve the yield of products and reduce their manufacturing cost.

DETAILED DESCRIPTION OF THE INVENTION

Figure 1:
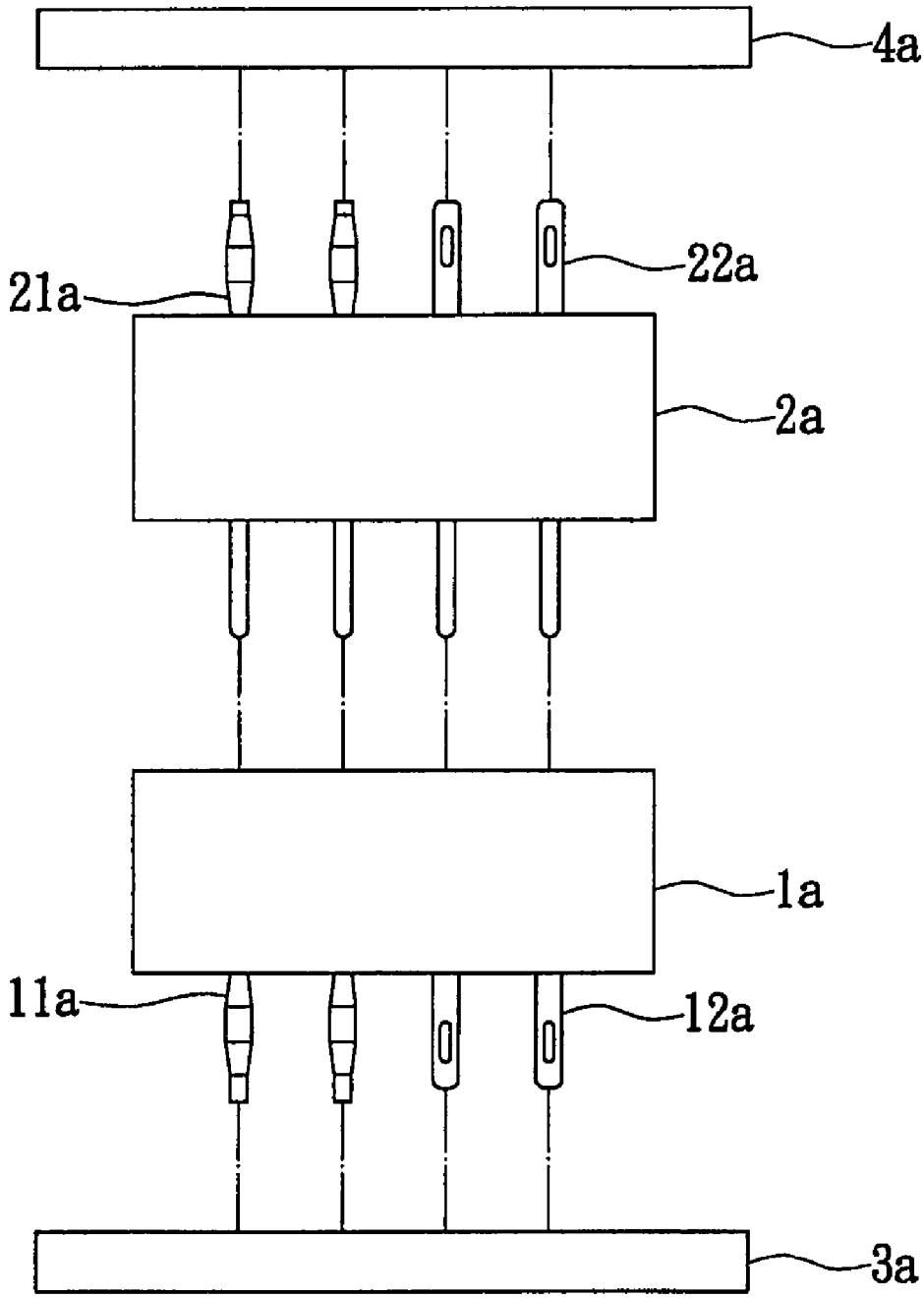
FIG. 1 PRIOR ART
FIG. 1 is a sketched view of a press-fit power connector device in an unused state.
Figure 2:
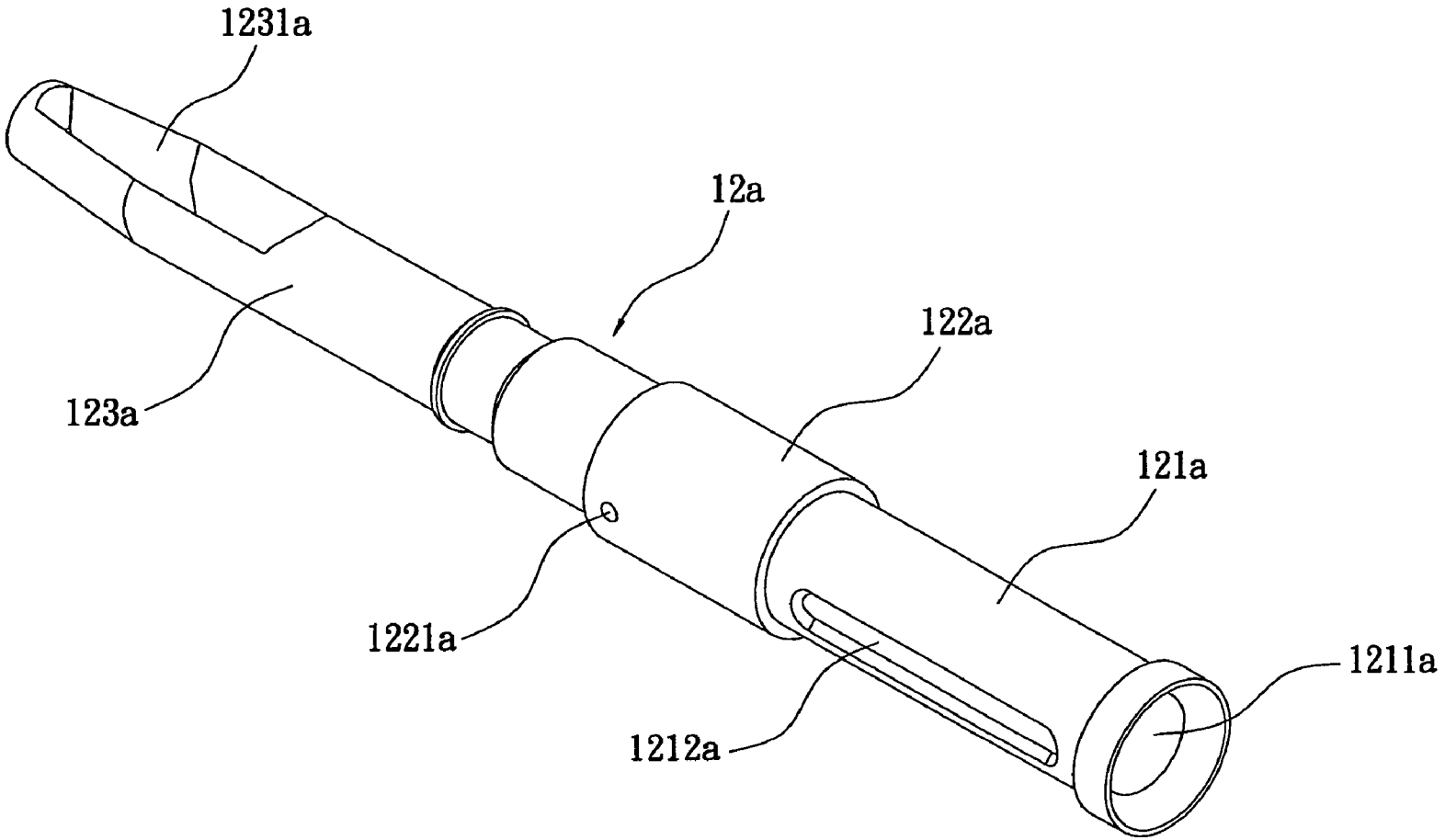
FIG. 2 PRIOR ART
FIG. 2 is a perspective view of a prior art female power terminal.
Figure 3:
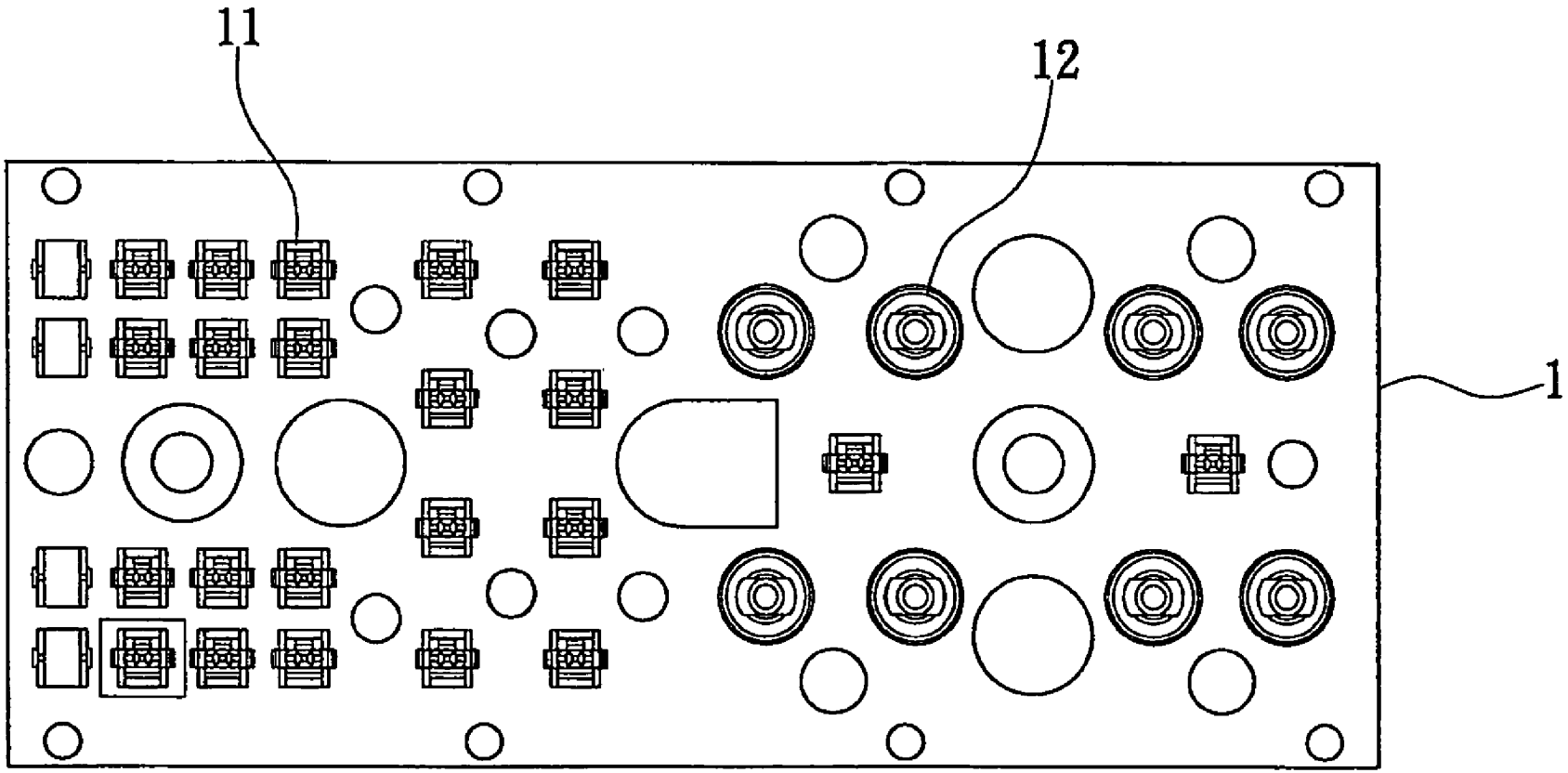
FIG. 3 is a top plan view of a female connector in accordance with the present invention.
Figure 4:
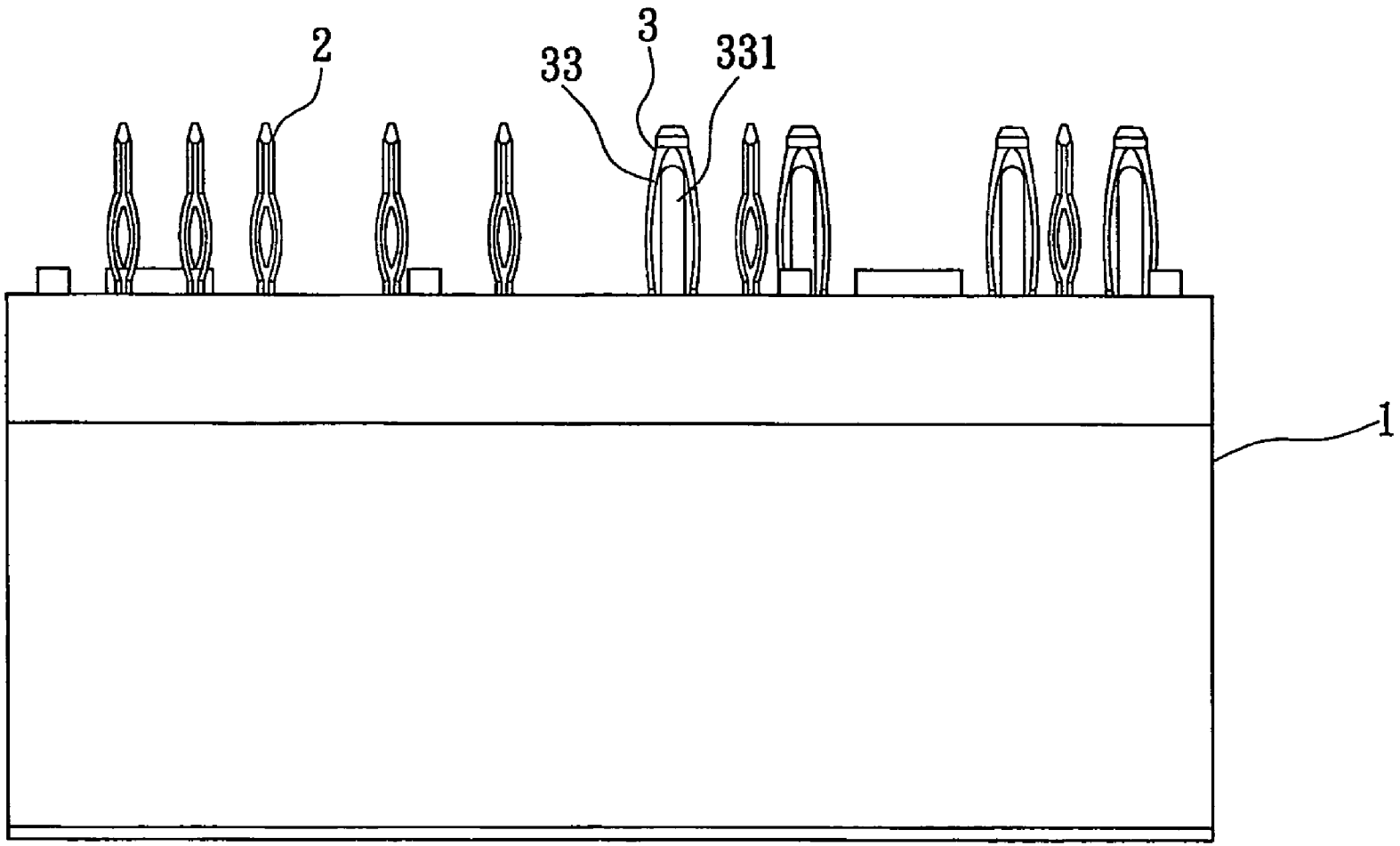
FIG. 4 is a side elevational view of the female connector in accordance with the present invention.

Please refer to FIG. 3 and FIG. 4 in which a preferred embodiment of the present invention is shown. The embodiment is called a press-fit power connector such as an ATCA. The present invention provides a press-fit power connector which includes a female terminal base 1, a plurality of female signal terminals 2, and a plurality of female power terminals 3. The female signal terminals 2 are mounted on the female terminal base 1. The female power terminals 3 are mounted on the female terminal base 1. The female power terminals 3 can also be used on any other type of press-fit power connector such as a CPCI in accordance with the present invention The female terminal base 1 has a plurality of female signal terminal holes 11 and a plurality of female power terminals holes 12. The female signal terminal holes 11 are shaped like square holes and the female power terminal holes 12 are shaped like circular holes.

Figure 5:
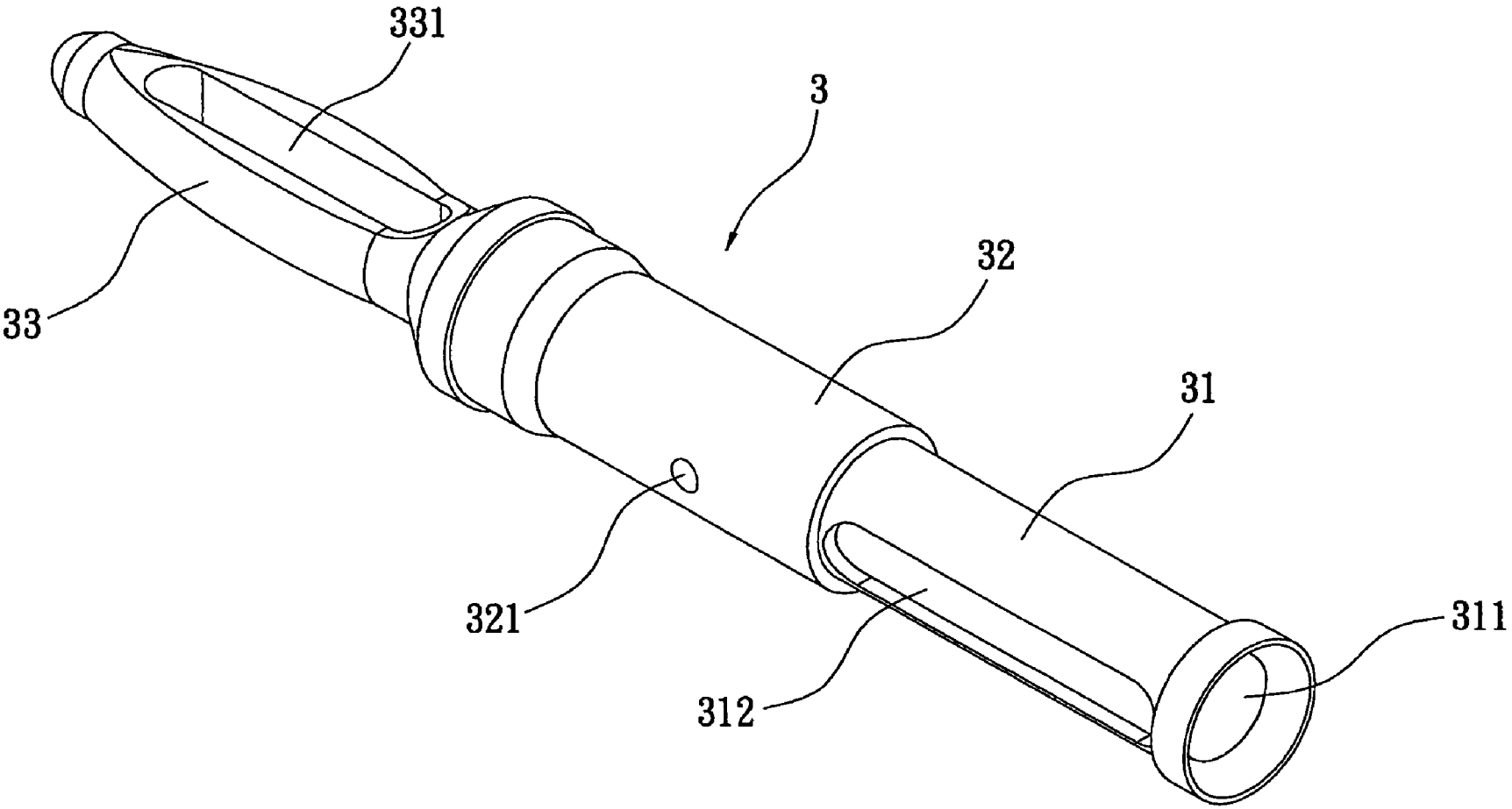
FIG. 5 is a perspective view of a female power terminal in accordance with the present invention.

Please refer to FIG. 5. Each of the female power terminals 3 includes a terminal contacting portion 31, a fixing portion 32, and a pin portion 33. The terminal contacting portion 31 has an end hole 311 on one end and a clamp slot 312 on a side. The clamp slot 312 and the end hole 311 connect with each other. The fixing portion 32 is formed by extending the other end of the terminal contacting portion 31. There is a borehole 321 or a plurality of boreholes 321 on t the fixing portion 32. The pin portion 33 is formed by bending and extending the end of the fixing portion 32, which is far away from the terminal contacting portion 31. There is an eye of needle 331 on the pin portion 33.

The female signal terminals 2 are inserted in the female signal terminal holes 11, respectively. The female power terminals 3 are inserted in the female power terminal holes 12, respectively. The terminal contacting portion 31 and the fixing portion 32 are mounted inside the female terminal base 1. The pin portion 33 is outside the female terminal base 1.

Figure 6:
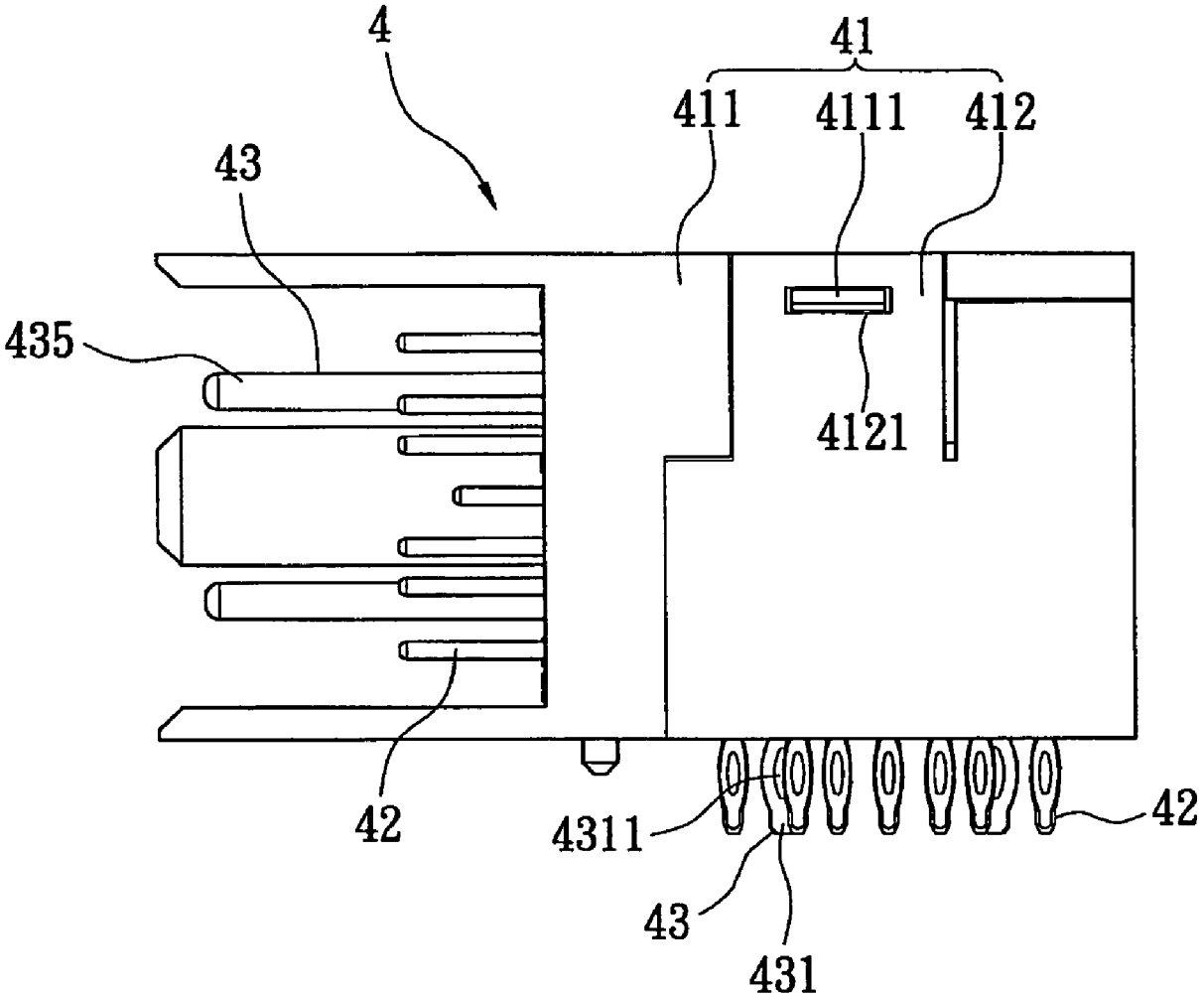
FIG. 6 is a side elevational view of a male connector in accordance with the present invention.
Figure 7:
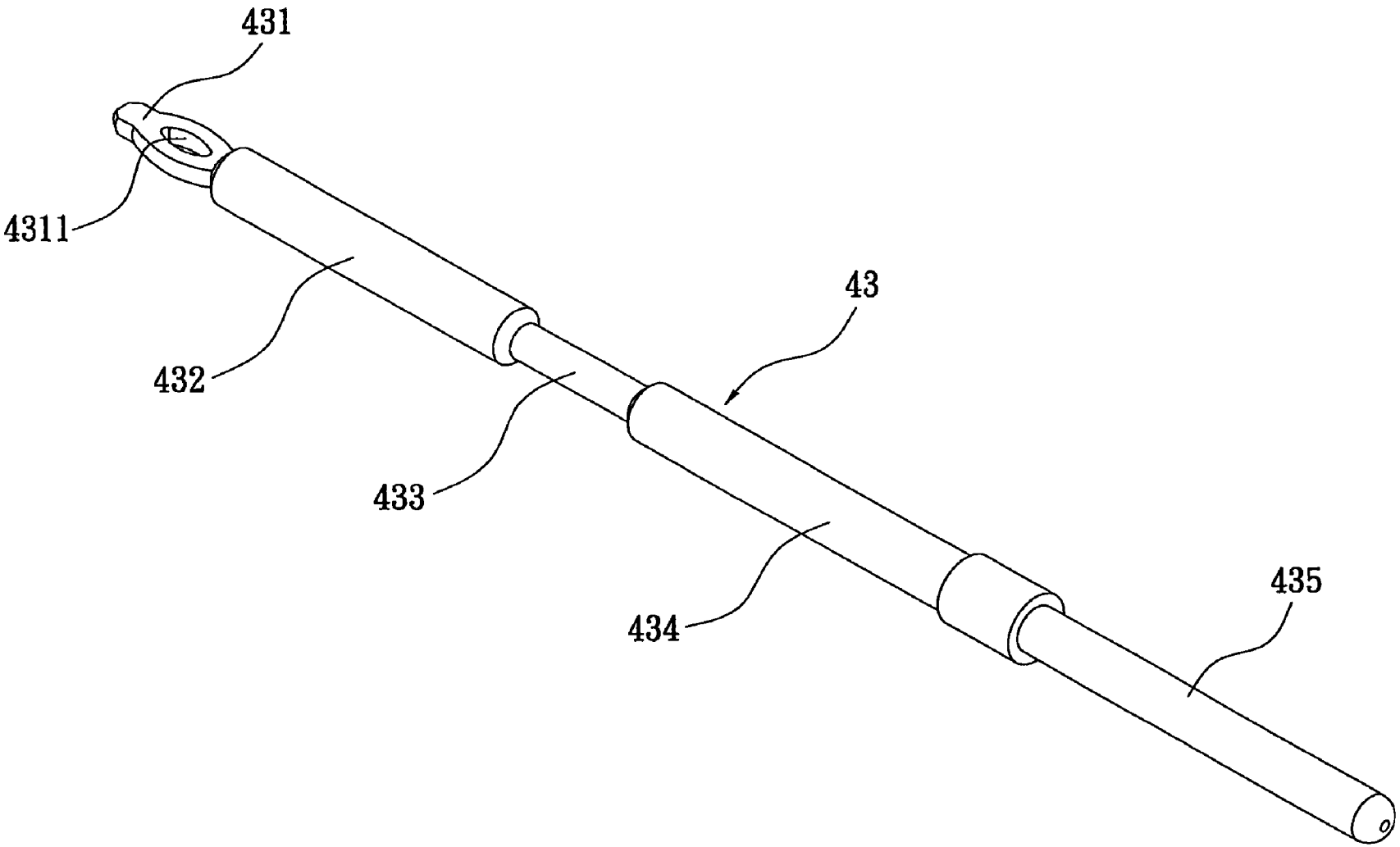
FIG. 7 is a perspective view of a male power terminal in accordance with the present invention
Figure 8:
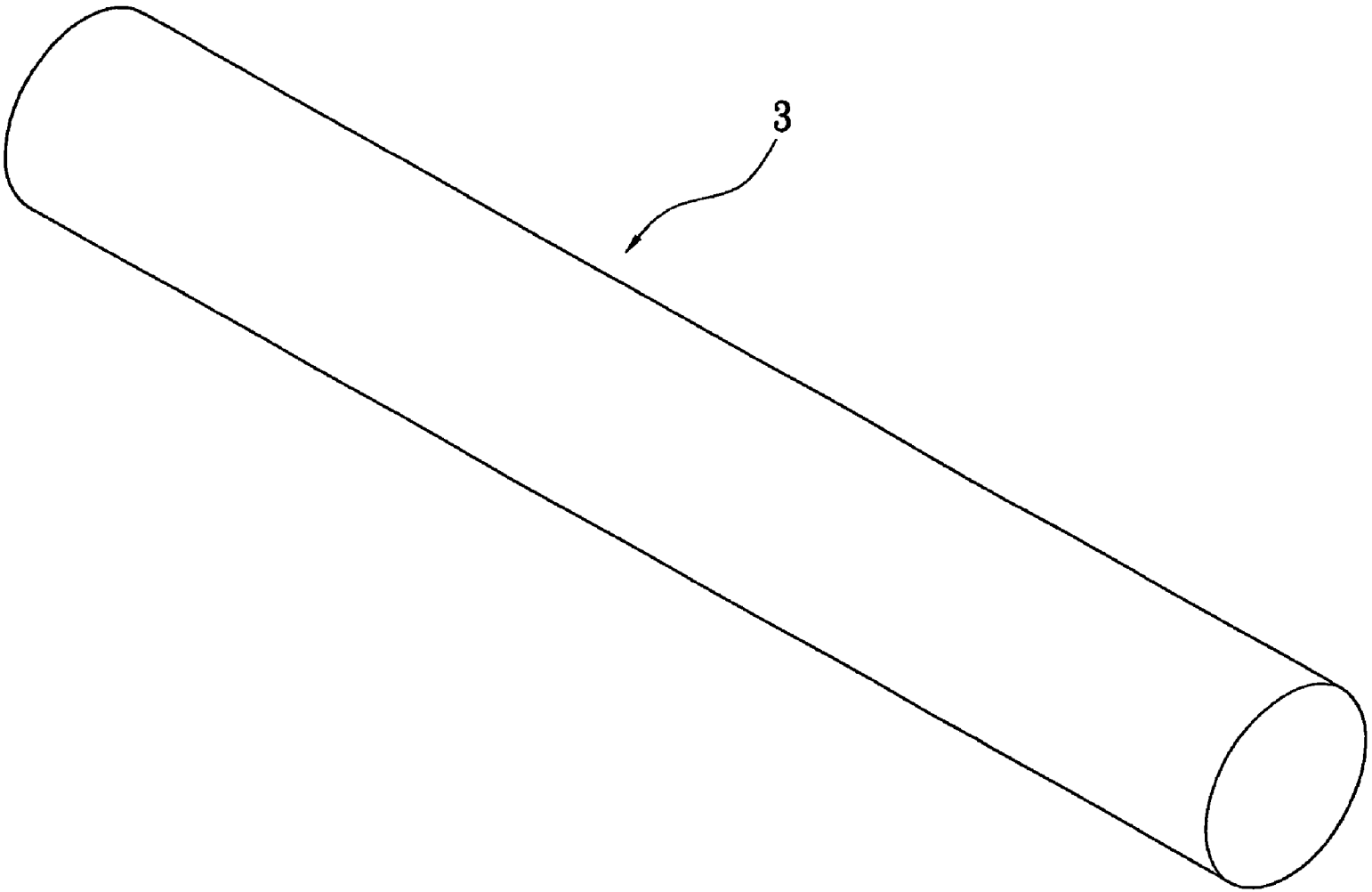
FIG. 8 is a flow chart (1) of manufacturing the female power terminal in accordance with the present invention
Figure 9:
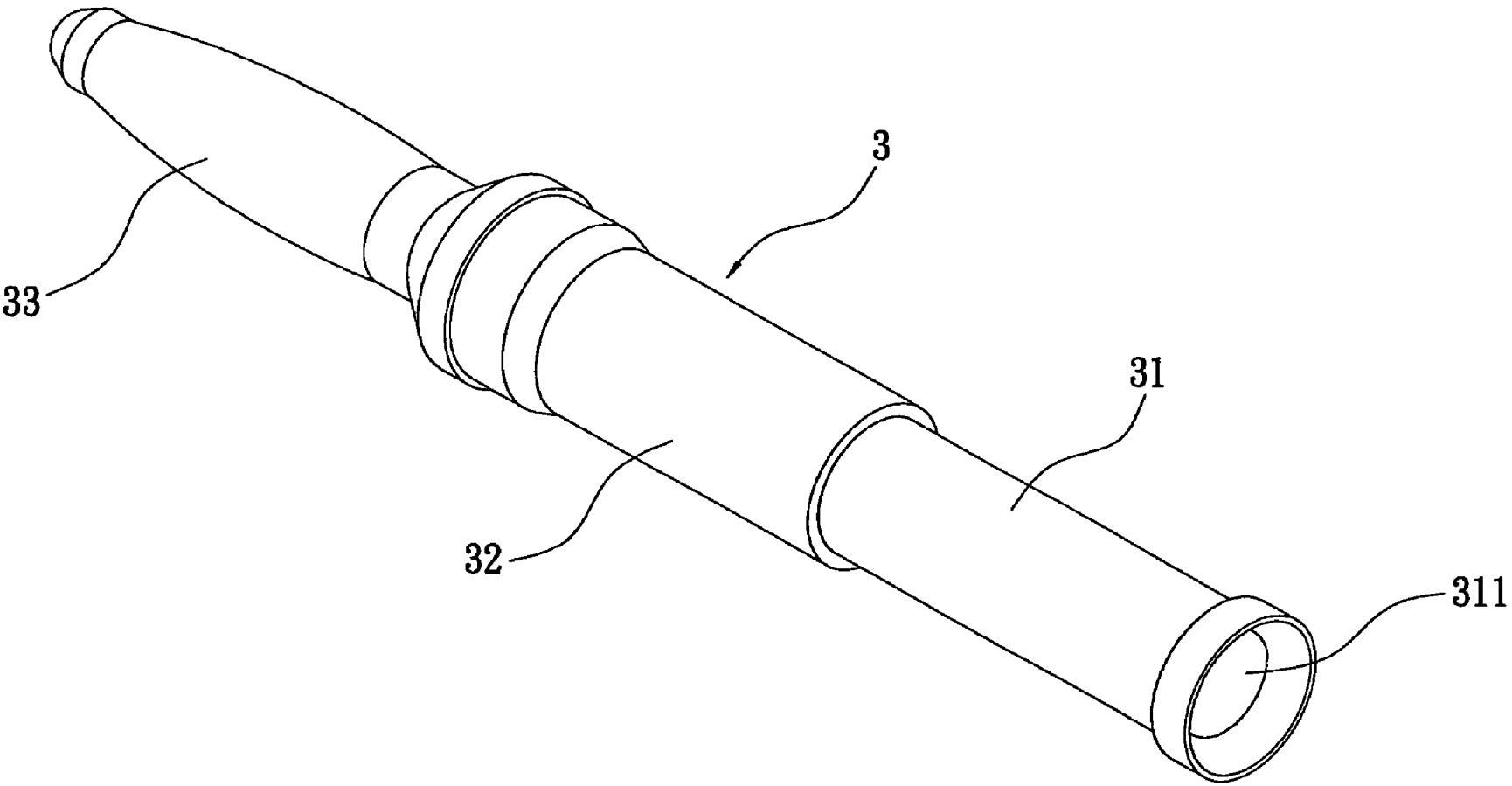
FIG. 9 is a flow chart (2) of manufacturing the female power terminal in accordance with the present invention
Figure 10:
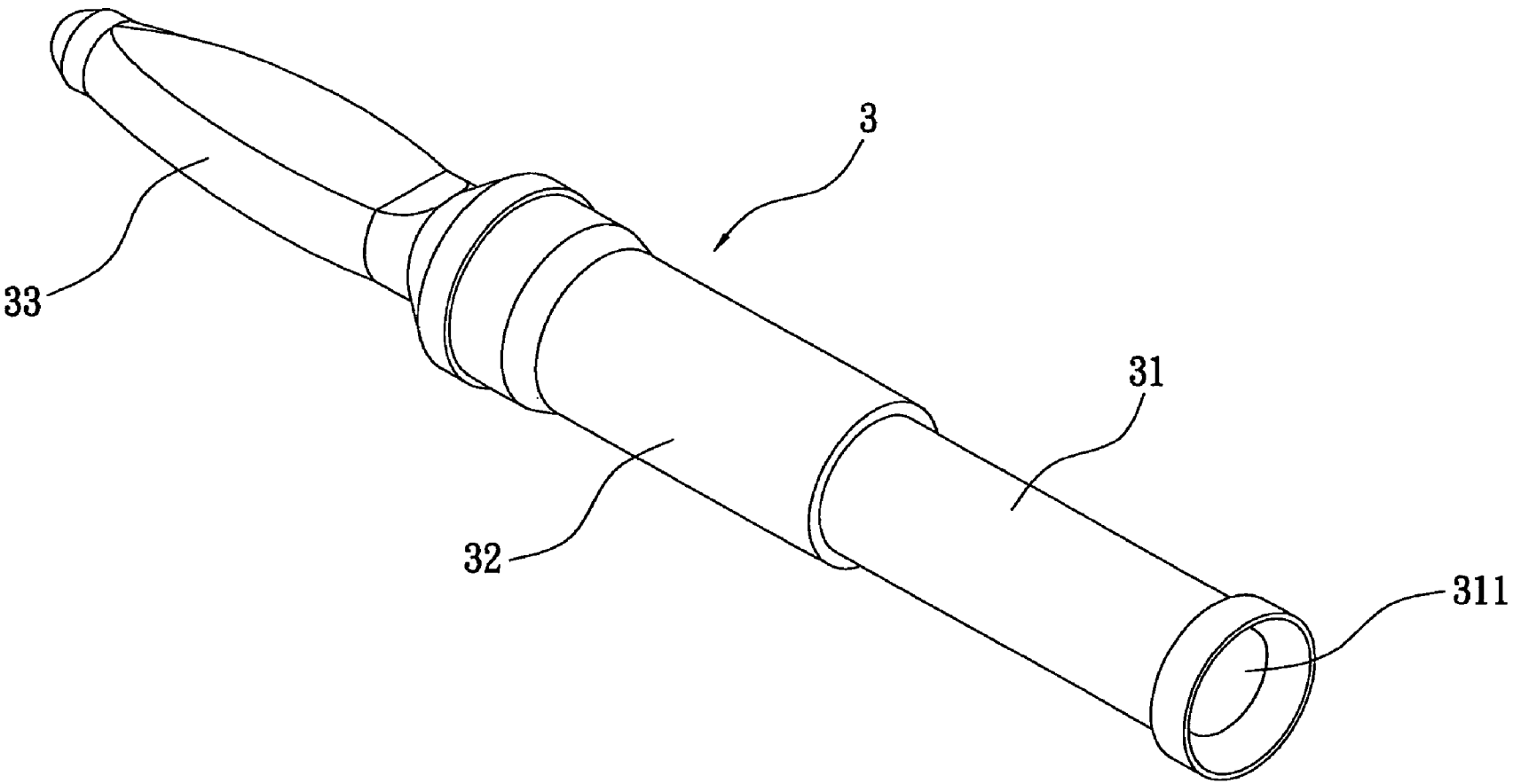
FIG. 10 is a flow chart (3) of manufacturing the female power terminal in accordance with the present invention
Figure 11:
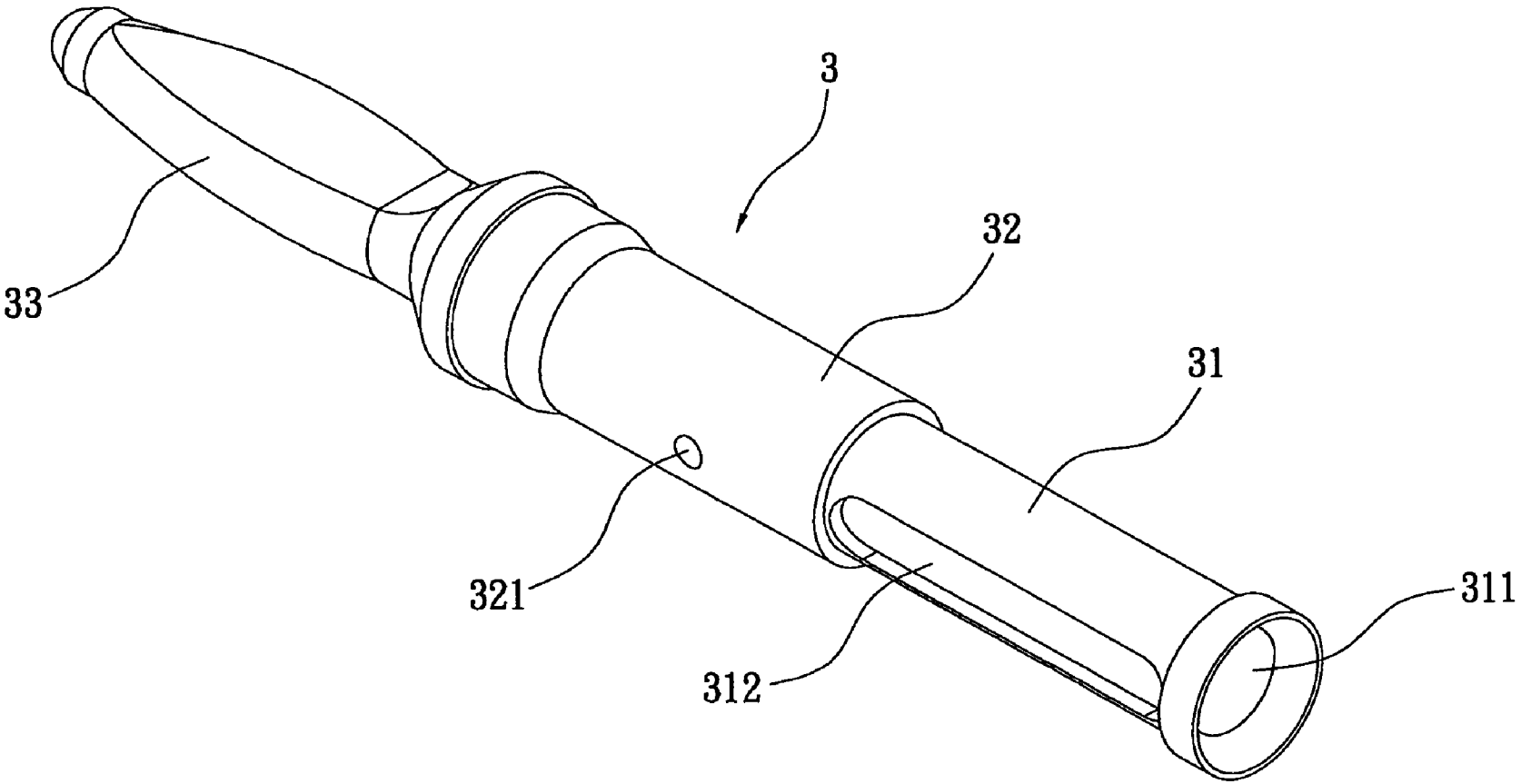
FIG. 11 is a flow chart (4) of manufacturing the female power terminal in accordance with the present invention
Figure 12:
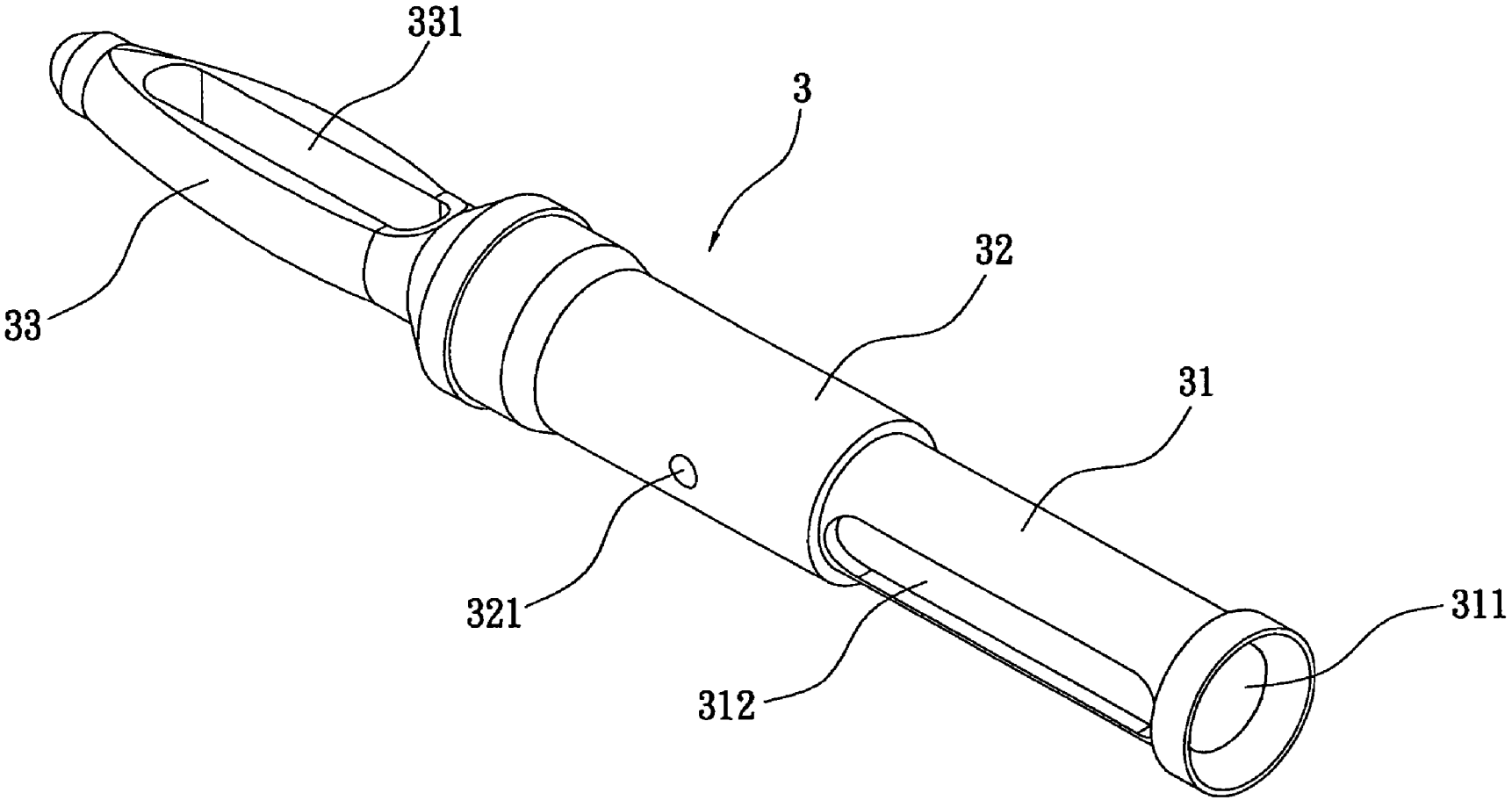
FIG. 12 is a flow chart (5) of manufacturing the female power terminal in accordance with the present invention

The present invention relates to a female connector structure for a press-fit power connector device. When used, the present invention needs to engage with a male connector 4. Please refer to FIG. 6 and FIG. 7. The male connector 4 includes a male terminal base 41, a plurality of male signal terminals 42, and a plurality of male power terminals 43. The male terminal base 41 includes a first shell 411 and a second shell 412. The first shell 411 has two fastening strips 4111 respectively disposed on two sides thereof and the second shell 412 has two fastening holes 4121 respectively formed on two sides thereof. The two fastening strips 4111 respectively fasten the two fastening holes 4121 so that the first shell 411 and the second shell 412 can fasten with each other and be fixed.

Each of the male power terminals 43 includes a pin portion 431, a first fixing portion 432, a bendable connecting portion 433, a second fixing portion 434, and a terminal contacting portion 435. There is an eye of needle 4311 on the pin portion 431. The first fixing portion 432 connects with the pin portion 431. The connecting portion 433 is connected between the first fixing portion 432 and the second fixing portion 434. The terminal contacting portion 435 connects with the end of the second fixing portion 434, which is far away from the connecting portion 433. The first fixing portion 432, the connecting portion 433, the second fixing portion 434, and the terminal contacting portion 435 are all shaped like poles. The external diameter of the first fixing portion 432 is equal to that of the second fixing portion 434. Of course, the external diameters of the first fixing portion 432 and the second fixing portion 434 can be not equal, which is not shown. The external diameter of the connecting portion 433 is smaller than that of the first fixing portion 432. Alternatively, the external diameter of the connecting portion 433 can also be equal to that of the first fixing portion 432, which is not shown. When the external diameter of the connecting portion 433 is smaller than that of the fixing portion 432, the connecting portion 433 is easily bent, which is preferable.

Each of the male power terminals 43 has a board-shaped pin portion 431 on one end which extends out of one side of the second shell 412. Each pin portion 431 has an eye of needle 4311. Each of the male power terminals 43 has a terminal contacting portion 435 on one end which extends out of one side of the first shell 411. Each pin portion 431 electrically connects to a circuit board (not shown). The terminal contacting portion 435 of each male power terminal 43 electrically connects with the terminal contacting portion 31 of each female power terminal 3. The male power terminals 43 and the male signal terminals 42 have the same structure, but the male power terminals 43 are larger in size.

Please refer to FIGS. 8-12. Steps for manufacturing the female power terminal 3 are as follows:

(1) preparing a material (a copper stick);

(2) lathing an appearance by a lathe to form the terminal contacting portion 31, the fixing portion 32, and the pin portion 33, and boring the end hole 311 on one end of the terminal contacting portion 31;

(3) sawing a plane on the pin portion 33 using a side saw machine;

(4) milling the clamp slot 312 on a side of the terminal contacting portion 31 using a milling machine;

(5) boring the borehole 321 on the fixing portion 32 using a small drilling machine; and (6) milling the eye of needle 311 on the pin portion 33 using a milling machine (alternatively, punching the eye of needle 331 using a punch).

The female power terminal 3 of the press-fit power connector of the present invention can improve the yield of products and reduce their manufacturing cost. Furthermore, the male power terminal 43 has a good guiding function.

What is disclosed above is only the preferred embodiment of the present invention and it is therefore not intended that the present invention be limited to the particular embodiments disclosed. It will be understood by those skilled in the art that various equivalent changes may be made depending on the specification and the drawings of present invention without departing from the scope of the present invention.

What is claimed is:

1. A press-fit power connector, comprising:

a female terminal base;

a plurality of female signal terminals, mounted on the female terminal base; and a plurality of unitary female power terminals, mounted on the female terminal base and each having a terminal contacting portion, a fixing portion integrally formed and connected with said contacting portion and a pin portion integrally formed and connected with said contacting portion, wherein the terminal contacting portion and the fixing portion are mounted inside the female terminal base, the pin portion is disposed outside the female terminal base, the terminal contacting portion has an end hole and a clamp slot on one end, the end hole connecting with the clamp slot, the fixing portion is formed by extending the other end of the terminal contacting portion and the pin portion is formed by bending and extending one end of the fixing portion in a direction which is opposite from the terminal contacting portion, wherein each pin portion further has a needle eye opening.

2. The press-fit power connector as claimed in claim 1, wherein there is a plurality of female signal terminal holes and a plurality of female power terminal holes on the female terminal base, the female signal terminal holes are shaped like square holes, the female power terminal holes are shaped like circular holes, the unitary female power terminals are respectively inserted in the female power terminal holes, and the female signal terminals are respectively inserted in the female signal terminal holes.

3. The press-fit power connector as claimed in claim 1, wherein each fixing portion has at least one borehole.

* * * * *